US005152546A

United States Patent [19]

Dunand et al.

[11] Patent Number: 5,152,546

[45] Date of Patent: Oct. 6, 1992

[54] BINDING FOR CROSS-COUNTRY SKIS BINDING COMPRISING ELASTIC BUFFER

[75] Inventors: Josiane Dunand, Cran Gevrier; Marc Provence, Thorens les Glieres, both of France

[73] Assignee: Salomon S. A., Chavanod, France

[21] Appl. No.: 559,087

[22] Filed: Jul. 30, 1990

[30] Foreign Application Priority Data

Jul. 28, 1989 [FR] France ..... 89 10572

[51] Int. Cl.[5] ..... A63C 9/00

[52] U.S. Cl. ..... 280/615

[58] Field of Search ..... 280/615

[56] References Cited

U.S. PATENT DOCUMENTS

| | | | |
|---|---|---|---|
| 4,533,154 | 8/1985 | Bernard et al. | 280/615 |
| 4,787,155 | 11/1988 | Callegari | 280/615 |
| 4,995,632 | 2/1991 | Girault et al. | 280/615 |

FOREIGN PATENT DOCUMENTS

| | | | |
|---|---|---|---|
| 0131234 | 1/1985 | European Pat. Off. | 280/615 |
| 3606645 | 9/1987 | Fed. Rep. of Germany | 280/615 |
| 2537010 | 6/1984 | France | 280/615 |
| 2582226 | 11/1986 | France | 280/615 |

*Primary Examiner*—David M. Mitchell

*Attorney, Agent, or Firm*—Pollock, Vande Sande & Priddy

[57] ABSTRACT

This binding comprises an elastic buffer (20) or comparable device, designed to exert a return-motion stress on the boot when the latter is raised off the upper surface of the ski. The deformation of the elastic buffer during its compression by the boot when raised is controlled so as to avoid vertical expansion of the buffer during compression. The binding also comprises a housing (16) in which at least one part of the elastic buffer (20) may be fitted, and which has transverse dimensions greater than those of the elastic buffer.

19 Claims, 3 Drawing Sheets

BINDING FOR CROSS-COUNTRY SKIS BINDING COMPRISING ELASTIC BUFFER

FIELD OF THE INVENTION

The present invention relates to a cross-country ski binding of the type comprising an elastic buffer, or comparable device, designed to exert return-motion stress on the boot when the latter is raised off the upper surface of the ski.

BACKGROUND OF THE INVENTION

A binding of this type is known, for example, from FR 2 537 010 and FR 2 582 226.

In FR 2 537 010 in particular, the elastic buffer is constituted by a tubular element whose generatrix is perpendicular to the axis of the ski, this configuration being designed to allow progressive resistance to the pivoting motion of the boot.

In FR 2 582 226, the elastic element is constituted by a block of elastic material provided on the inside with honeycomb cells intended to facilitate its partial compression capacities during pivoting of the boot.

In FR 2 582 226, the elastic element also comprises, on its upper external surface, transverse grooves designed to facilitate its deformation.

Although these elastic elements constitute a definite improvement over elastic elements made of a single block of compact material, as in IT 193 815, they do not make it possible to solve all problems, in particular those linked to the compression of such a block when the boot is raised.

Indeed, this kind of compression necessarily causes the block to expand in directions other than the direction of compression, and this expansion may, after the boot has been raised a certain number of times, lead to the detachment of the elastic block from the binding, and to the loss of this block.

SUMMARY OF THE INVENTION

It is an object of the present invention to solve these problems, to provide a cross-country ski binding and an elastic buffer securely held in position in the binding during cross-country skiing, and to avoid untimely loss of this block.

Another object of the present invention is to assure that the elastic buffer returns effectively to its original shape after deformation.

This object is achieved in the binding according to the invention by providing means to control the deformation of the elastic buffer during its compression by the boot when the latter is raised.

Indeed, the control of the deformation of the elastic buffer during repeated stresses exerted on it, not only prevents the buffer from detaching, but also promotes an effective return to its original shape, while avoiding any blocking effect created by its deformation.

According to a preferred embodiment, the buffer deformation-control means prevent vertical expansion of the buffer during compression, thus assuring that the buffer will be kept in a proper vertical position.

The binding advantageously comprises a housing adapted to receive at least one part of the elastic buffer. This housing has transverse dimensions greater than those of the elastic buffer. This kind of arrangement permits transverse expansion of the elastic buffer and consequently limits appreciably the tendency of the buffer to "swell" vertically and to leave its housing.

BRIEF DESCRIPTION OF THE DRAWINGS

The invention will be better understood from the following description provided with reference to the attached drawings which illustrate, by way of example, several embodiments of the invention, and in which.

DESCRIPTION OF THE PREFERRED EMBODIMENTS

Figure 1:
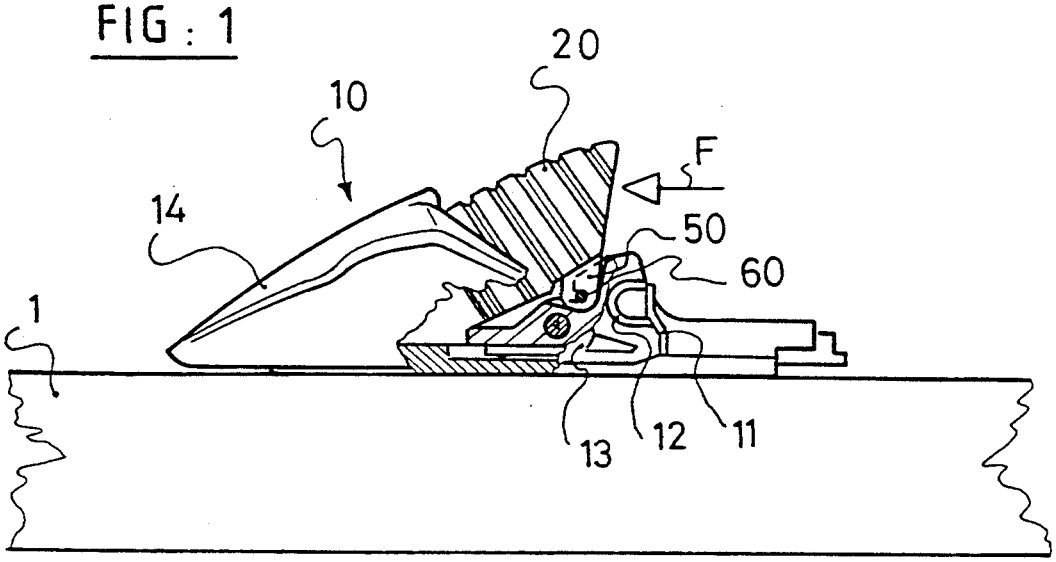
FIG. 1 is a side view, partly in section, of a cross-country ski binding incorporating an elastic buffer according to the invention.
Figure 2:
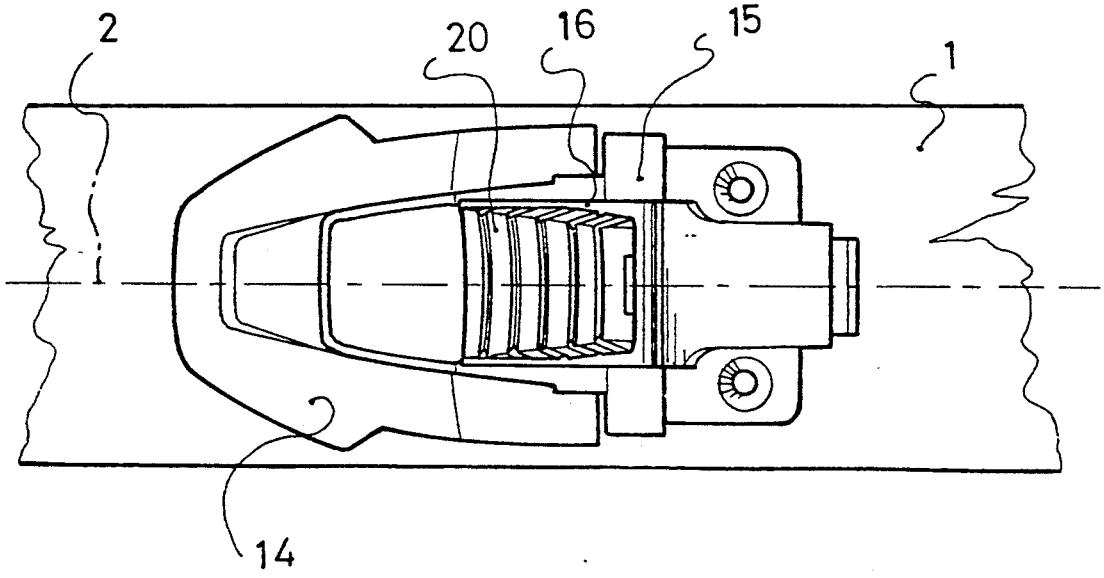
FIG. 2 is a top plan view of FIG. 1.

FIGS. 1 and 2 illustrate a hinge-type cross-country ski binding 10 attached to a cross-country ski 1 and incorporating an elastic buffer 20 according to the invention. The type of cross-country ski binding illustrated is already known, and is described, for example, in applicant's French Patent Application No. 88.111104. In this type of binding, the boot (not shown) is assembled to the ski while being rotatable about a pin unitary with the boot, the boot pin being held between a stationary jaw 11 and a movable jaw 12 of this binding. In this case, the movable jaw 12 is mounted on a carriage which may be moved longitudinally in relation to the ski and which can be maneuvered by use of a lever 14. The frame 15 of the binding delimits, moreover, a housing 16 for the elastic buffer 20, as will be seen below.

The elastic buffer 20 is illustrated in more detail in FIGS. 3 to 7.

Figure 4:
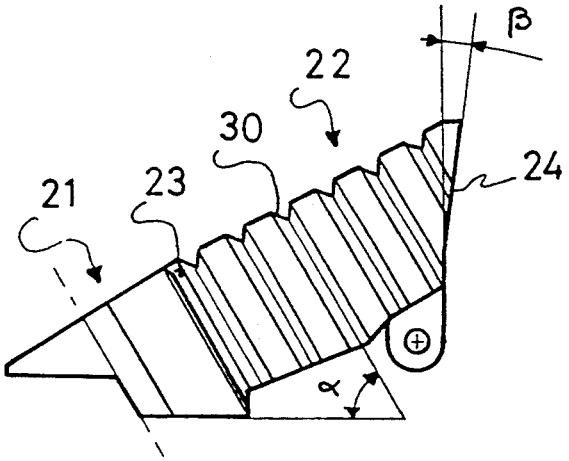
FIG. 4 is a side view of the elastic buffer shown in FIG. 3.

As shown especially in FIG. 4, elastic buffer 20 comprises two parts, an embedded part 21 and a part 22 designed more specifically to be deformed.

The embedded part 21 of the buffer is designed to be fitted into the housing 16 provided for this purpose in the frame 15 of the binding, while the deformation part 22 of the buffer is designed to cooperate more especially with the boot by means of an associated support surface 24.

As emerges more especially from FIG. 2, the housing 16 in the frame for the elastic buffer 20 has transverse dimensions which are greater than those of the elastic buffer 20. In consequence, therefore, there is play between the lateral walls of the buffer 20 and the lateral walls of the housing 16, allowing transverse expansion of the buffer 20 when compressed by the boot, but without hindering its penetration into the housing 16.

It will be noted that, if this play did not exist as soon as longitudinal compression was exerted, transverse expansion would immobilize the buffer against the walls of the frame 15, thereby preventing any penetration into the housing 16 and thus limiting the longitudinal motion of the buffer. This type of arrangement thus promotes the transverse expansion of the elastic buffer 20 and therefore limits the tendency of the latter to expand or dilate vertically when compressed. In this manner, a first control of the deformation of the elastic buffer is obtained in a direction other than the direction of compression of the buffer by the boot (i.e., the direction indicated by arrow F in FIG. 1).

Figure 3:
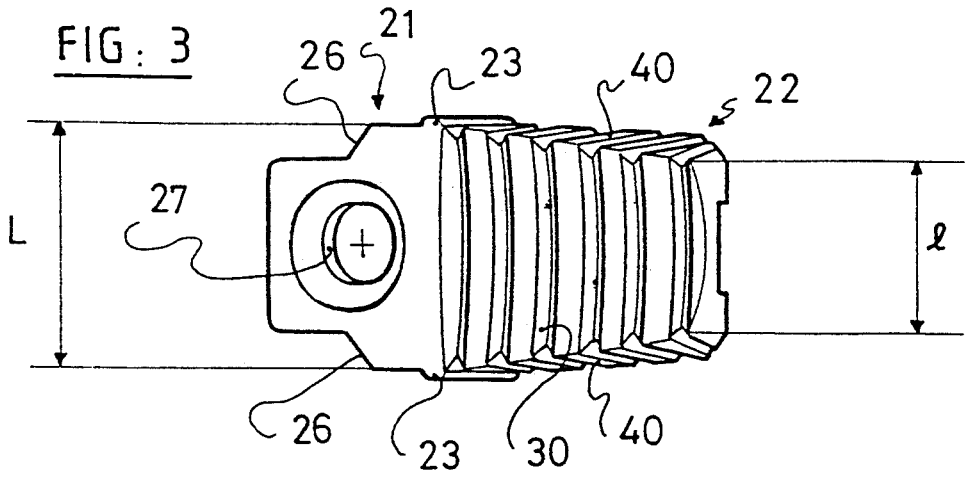
FIG. 3 is a view, similar to FIG. 2 showing the elastic buffer by itself.

As shown particularly in FIGS. 3 and 4, the elastic buffer comprises, in the zone where the embedded part 21 meets deformation part 22, a peripheral sealing lip 23 protruding beyond these two parts. This sealing lip 23 extends transversely along a dimension corresponding to the inner transverse dimension of housing 16, and thus ensures the sealing of this housing 16 with respect to the exterior.

As illustrated more especially in FIG. 3, sealing lip 23 extends solely over the lateral surfaces 40 of buffer 20.

Part 21 of the buffer, designed to be embedded into housing 16 of frame 15, has two lateral shoulders 26, which are designed to cooperate with the associated parts of the housing 16 (not shown for reasons of clarity) in order to support the elastic buffer in housing 16.

As FIG. 3 illustrates in greater detail, these two support shoulders 26 of the buffer are as remote as possible from the support face 24 of the boot, so as not to hinder the compression of the elastic buffer and its penetration into the frame. Thus, support shoulders 26 are provided in the front end of the embedding part 21 of the buffer. It will be noted that these lateral supports could be replaced by a central support, for example, one installed at the extreme front end of the embedding part; however, the lateral arrangement of the supports is preferable, so as to allow an available deformation volume for the buffer in its median area. It will also be noted that the role of the lateral support shoulders 26 is to assist the elastic buffer 20 to return to its original position after the compression phase. Finally, it will be seen that the embedding part 21 of the buffer has a hole 27 intended for an assembly screw which fastens the binding 10 to the ski. The provision of this hole 27 allows the binding to be delivered with the elastic buffer 20 premounted.

The elastic buffer 20 has, on the outside of its deformation part 22, a series of parallel grooves 30 extending perpendicularly to the longitudinal direction 2 of the ski.

As illustrated in FIGS. 3 and 4, these grooves 30 extend over both the lateral walls 40 and the upper wall 41 of the deformation part 22 of the elastic buffer. Each of these grooves 30 has, in transverse section, a substantially triangular shape and is inclined at an angle of about 60° with the horizontal.

Figure 5:
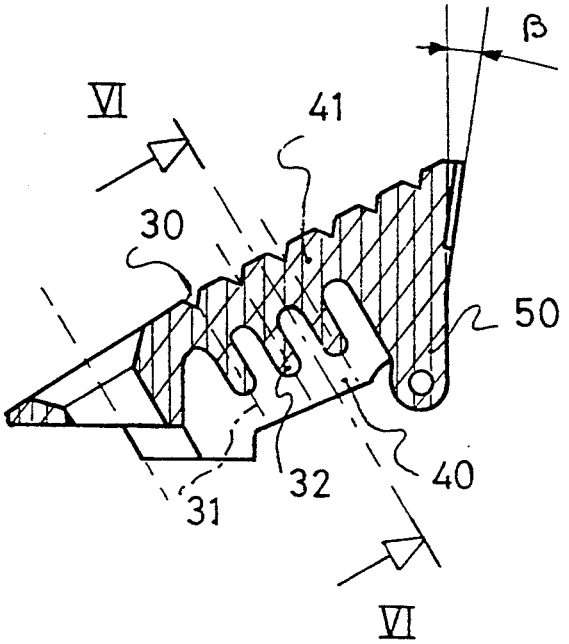
FIG. 5 is a longitudinal cross-section of the elastic buffer illustrated in FIG. 3.
Figure 7:
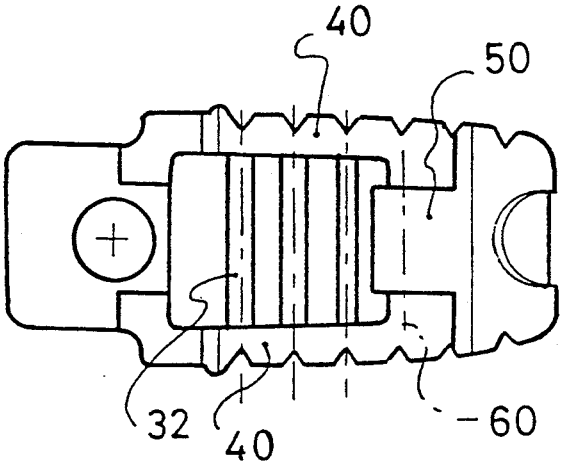
FIG. 7 is a bottom plan view of the buffer shown in FIGS. 3 to 6 according to a first embodiment.

On the inside of its deformation part, the elastic buffer also has a series of ribs 32 extending parallel to each other (see FIGS. 5 and 7).

As illustrated more especially in FIG. 5, these ribs 32 extend, as do grooves 30, perpendicular to the longitudinal direction 2 of the ski, and each of these ribs 32 extends in the extension of one of grooves 30. Furthermore, each of these ribs 32 is inclined at the same angle $\alpha$ to the horizontal as grooves 30.

As a result and as illustrated more especially in FIG. 5, the connected ribs and grooves will have a single median plane 31.

It will be noted that the inner ribs 32 are designed to exert a certain retention force holding the lateral walls of the elastic buffer. On the other hand, the outer grooves 30 are designed to allow better compression of the elastic buffer by arranging the different successive layers created between each of these grooves 30. Moreover, the triangular section of these grooves facilitates their closing when the elastic buffer undergoes compression.

Figure 6:
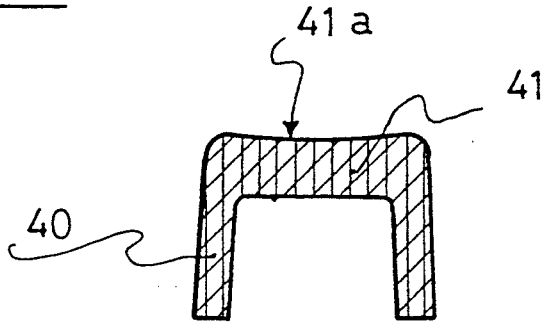
FIG. 6 is a cross-section view along line VI—VI in FIG. 5.

As illustrated in FIG. 6, deformation zone 22 of the upper wall 41 of the elastic buffer has a slight upward, transverse concavity 41*a*, designed to prevent the upward swelling of the elastic buffer during compression and to facilitate the penetration of the buffer into its housing when compressed. Furthermore, the elastic buffer has, in its deformation part, a substantially pyramidal shape which thins progressively toward the support surface 24 of the boot. Accordingly, the width l of the elastic buffer at the level of its support surface 24 is less than its width L at the level of its embedding zone 21. In practice, the optimal ratio l/L was determined to be 75%.

FIG. 4 illustrates that the support surface 24 of the boot is inclined to the horizontal at an angle $\beta$ of approximately 10°. This inclination is provided to improve the contact of the elastic buffer with the associated support surface of the boot when the latter is put in position. It is also designed to allow prestressing of the elastic buffer on the boot.

Finally, the elastic buffer has, fitted on the extension of its support surface 24 for the boot, a connecting tongue 50 extending downward and designed to be anchored in an associated part of the binding.

Figure 8:
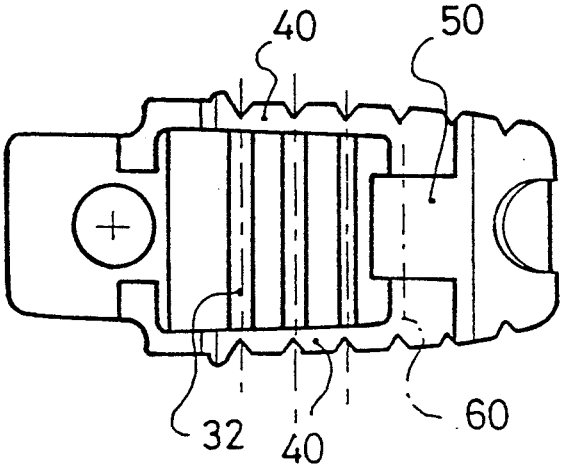
FIG. 8 is a view similar to FIG. 7 of an elastic buffer according to a second embodiment.

As illustrated more specifically in FIGS. 7 and 8, this tongue 50 extends transversely and is recessed in relation to the lateral walls 40 of the buffer, and is thus completely independent of the functional part of the elastic buffer. Accordingly, the elastic tongue does not hinder the compression of the edges or lateral walls 40 of the elastic buffer. This connecting tongue 50 is designed to be secured in the housing using a pin 60 (illustrated in FIG. 1 and indicated in the other Figures by its axis). It will be noted that, because it is anchored in the binding 50, this tongue 50 prevents any upward detachment of the elastic buffer when the boot is raised, and, therefore, when the buffer is compressed. Moreover, it allows the buffer 20 to be attached to the binding before the binding is mounted on the ski, thereby ensuring that the buffer will not be lost in transit.

Finally, comparison of FIGS. 7 and 8 shows a possible modification of the interior structure of the elastic buffer 20 making it possible to increase or reduce its stiffness, as required. Such modification of stiffness may be effected very simply by varying the transverse thickness of the lateral walls 40 of this type of spring, and potentially the thickness of its inner ribs 32, this modification of thickness being obtainable very simply during molding by a simple change of the mold core.

What is claimed is:

1. Binding for linking a boot to a cross-country ski of a type comprising an elastic buffer (20) exerting return motion stress on said boot when said boot is raised off an upper surface of said ski, said elastic buffer (20) comprising an embedding part (21) embedded in a housing (16) of said binding and a deformation part (22) which is deformed when said boot is raised, said deformation part (22) comprising a support surface (24) directly in contact with said boot for exerting return motion stress on said boot when raised off said upper surface of said ski, said housing (16) receiving at least said embedding part (21) of said buffer (20), said buffer having a peripheral sealing lip (23) in a zone where said embedding part (21) and said deformation part (22) meet, said sealing lip projecting outward from said embedding and deformation parts and extending transversely along a dimension corresponding to an inner transverse dimension of said housing (16), thus ensuring sealing of said housing (16) with respect to an exterior of said housing.

2. Binding according to claim 1, wherein said sealing lip (23) extends only over lateral surfaces (40) of said buffer.

3. Binding according to claim 1, comprising external grooves (30) in said deformation part, said grooves extending perpendicular to a longitudinal direction (2) of said ski and over at least a part of an outer surface of said deformation part, wherein said buffer (20) has an interior comprising ribs (32) also extending perpendicular to said longitudinal direction of said ski, each of said ribs (32) extending in an extension of one of said grooves (30).

4. Binding according to claim 3, wherein said ribs (30) and said grooves (30) are inclined in a same direction.

5. Binding according to claim 4, wherein an inclination $\alpha$ of a median plane (31) of each said rib (32) and a said groove (30) is approximately 60° to the horizontal.

6. Binding according to claim 3, wherein said buffer comprises lateral walls (40) and an upper wall (41) over which each said groove (30) extends.

7. Binding according to claim 1, wherein said support surface (24) of said deformation part is inclined at approximately 10° to the vertical.

8. Binding according to claim 1, wherein said deformation part (22) of said elastic buffer has a substantially pyramidal shape which narrows progressively in a direction toward said support surface (24) for said boot.

9. Binding according to claim 1, wherein said deformation part (22) of said buffer has ends whose transverse dimensions are in a ratio of about 75° to one another.

10. Binding according to claim 1, wherein said deformation part (22) of said elastic buffer (20) comprises an upper wall (41) having a slight transversely-extending concavity (41*a*).

11. Binding according to claim 1, wherein said buffer has lateral walls (40), and in an extension of said support surface (24) for said boot, a connecting tongue (50) extending downward and adapted to be anchored in an associated part of said binding, said tongue (50) extending transversely and being recessed in relation to said lateral walls (40) of said buffer (20).

12. Binding for linking a boot to a cross-country ski of a type comprising an elastic buffer (20) exerting return motion stress on said boot when said boot is raised off an upper surface of said ski, said elastic buffer (20) comprising an embedding part (21) embedded in a housing (16) of said binding and a deformation part 922) which is deformed when said boot is raised, said deformation part (22) comprising a support surface (24) directly in contact with said boot for exerting return motion stress on said boot when raised off said upper surface of said ski, said housing (16) receiving at least said embedding part (21) of said buffer (20) and having transverse dimensions greater than transverse dimensions of said buffer, comprising external grooves (30) in said deformation part, said grooves extending perpendicular to a longitudinal direction (2) of said ski and over at least a part of an outer surface of said deformation part, wherein said buffer (20) has an interior comprising ribs (32) also extending perpendicular to said longitudinal direction of said ski, each of said ribs (32) extending in an extension of one of said grooves (30).

13. Binding according to claim 12, wherein said ribs (30) and said grooves (30) are inclined in a same direction.

14. Binding according to claim 13, wherein an inclination $\alpha$ of a median plane (31) of each said rib (32) and a said groove (30) is approximately 60° to the horizontal.

15. Binding according to claim 12, wherein said buffer comprises lateral walls (40) and an upper wall (41) over which each said groove (30) extends.

16. Binding for linking a boot to a cross-country ski of a type comprising an elastic buffer (20) exerting return motion stress on said boot when said boot is raised off an upper surface of said ski, said elastic buffer (20) comprising an embedding part (21) embedded in a housing (16) of said binding and a deformation part (22) which is deformed when said boot is raised, said deformation part (22) comprising a support surface (24) directly in contact with said boot for exerting return motion stress on said boot when raised off said upper surface of said ski, said housing (16) receiving at least said embedding part (21) of said buffer (20) and comprising means for controlling deformation and preventing vertical expansion of said buffer when compressed, comprising external grooves 930) in said deformation part, said grooves extending perpendicular to a longitudinal direction (2) of said ski and over at least a part of an outer surface of said deformation part, wherein said buffer (20) has an interior comprising ribs (32) also extending perpendicular to said longitudinal direction of said ski, each of said ribs (32) extending in an extension of one of said grooves(30).

17. Binding according to claim 16, wherein said ribs (30) and said grooves (30) are inclined in a same direction.

18. Binding according to claim 17, wherein an inclination $\alpha$ of a median plane (31) of each said rib (32) and a said groove (30) is approximately 60° to the horizontal.

19. Binding according to claim 16, wherein said buffer comprises lateral walls (40) and an upper wall (41) over which each said groove (30) extends.

* * * * *